US011131269B2

(12) United States Patent
Meske et al.

(10) Patent No.: US 11,131,269 B2
(45) Date of Patent: Sep. 28, 2021

(54) STEEL PISTON FOR AN INTERNAL COMBUSTION ENGINE

(71) Applicant: FEDERAL-MOGUL NURNBERG GMBH, Nuremberg (DE)

(72) Inventors: Ralf Meske, Schwabach (DE); Lukas Merz, Nuremberg (DE); Michael Kraemer, Weiler Zum Stein (DE); Christoffer Schmoll, Nuremberg (DE)

(73) Assignee: Federal-Mogul Nurnberg GmbH, Nuremberg (DE)

( * ) Notice: Subject to any disclaimer, the term of this patent is extended or adjusted under 35 U.S.C. 154(b) by 188 days.

(21) Appl. No.: 16/464,423

(22) PCT Filed: Aug. 17, 2017

(86) PCT No.: PCT/EP2017/070830
§ 371 (c)(1),
(2) Date: May 28, 2019

(87) PCT Pub. No.: WO2018/095601
PCT Pub. Date: May 31, 2018

(65) Prior Publication Data

US 2021/0115874 A1 Apr. 22, 2021

(30) Foreign Application Priority Data

Nov. 28, 2016 (DE) ..... 10 2016 223 530.3

(51) Int. Cl.
*F02F 3/22* (2006.01)
*F02F 3/00* (2006.01)

(52) U.S. Cl.
CPC ..... *F02F 3/22* (2013.01); *F02F 3/0084* (2013.01)

(58) Field of Classification Search
CPC ..... F02F 3/22; F02F 3/0084
See application file for complete search history.

(56) References Cited

U.S. PATENT DOCUMENTS

| | | | | |
|---|---|---|---|---|
| 5,894,824 | A * | 4/1999 | Watanabe | F02F 3/022 123/193.6 |
| 6,073,602 | A | 6/2000 | Muta | |
| 6,244,161 | B1 * | 6/2001 | Myers | C22C 38/12 92/224 |
| 6,357,341 | B1 * | 3/2002 | Watanabe | F02F 3/00 123/193.6 |
| 8,220,432 | B2 | 7/2012 | Iwata et al. | |
| 2001/0029840 | A1 | 10/2001 | Gaiser et al. | |

(Continued)

FOREIGN PATENT DOCUMENTS

| | | |
|---|---|---|
| CN | 102667124 A | 9/2012 |
| CN | 202970934 U | 6/2013 |

(Continued)

*Primary Examiner* — Joseph J Dallo
*Assistant Examiner* — Kurt Philip Liethen
(74) *Attorney, Agent, or Firm* — Robert L. Stearns; Dickinson Wright, PLLC

(57) ABSTRACT

A steel piston (10) for an internal combustion engine has a cooling channel and shaft surfaces (12, 14) with which the piston (10), in the installed state, abuts a cylinder bore or a cylinder liner on a pressure side and a counterpressure side, wherein one shaft surface (12) has a width which is 25-50% smaller than the other shaft surface (14).

5 Claims, 1 Drawing Sheet

(56) References Cited

U.S. PATENT DOCUMENTS

| | | | | |
|---|---|---|---|---|
| 2003/0037671 | A1* | 2/2003 | Zhu | F02F 3/003 92/231 |
| 2004/0094034 | A1 | 5/2004 | Oversby et al. | |
| 2008/0105118 | A1* | 5/2008 | Frank | F16J 1/16 92/208 |
| 2011/0107997 | A1 | 5/2011 | Muscas et al. | |
| 2012/0037112 | A1 | 2/2012 | Muscas | |
| 2013/0036997 | A1 | 2/2013 | Braig et al. | |
| 2015/0047498 | A1* | 2/2015 | Takada | F02F 3/0084 92/155 |

FOREIGN PATENT DOCUMENTS

| | | | | | |
|---|---|---|---|---|---|
| CN | 103732897 | A | | 4/2014 | |
| DE | 10230746 | A1 | | 1/2004 | |
| DE | 102011080822 | A1 | | 2/2013 | |
| FR | 822409 | A | | 12/1937 | |
| GB | 2367602 | A | | 4/2002 | |
| JP | 2000303905 | A | | 10/2000 | |
| JP | 2002317691 | A | | 10/2002 | |
| JP | 2012136972 | A | * | 7/2012 | F02F 3/00 |

* cited by examiner

STEEL PISTON FOR AN INTERNAL COMBUSTION ENGINE

BACKGROUND

1. Technical Field

The invention relates to a steel piston for an internal combustion engine.

2. Related Art

Especially for heavy-duty combustion engines, steel pistons are frequently used, which are generally designed rotationally symmetrical with respect to the piston axis. An example is the piston according to US 2012/0037112 A1. In addition, U.S. Pat. No. 8,220,432 B2 discloses a piston that is asymmetrical with regard to its shaft surfaces.

The width of the shaft surfaces is usually determined by the conditions relating to the installation space, which are defined by the small connecting rod eye and the oil spray nozzle position in the interior region of the piston. Due to the high cylinder peak pressures, the small connecting rod eye of heavy-duty pistons is relatively wide. The oil spray nozzle is placed next to the installation space consumed by the connecting rod swivel movement, as a result of which the minimum internal width of the shaft surfaces is determined. This results in a shaft width which is 70-80% of the piston diameter. The connecting walls between the shaft surface and the piston hub are usually formed in a straight manner.

In the case of pistons without valve pockets and without dislocation of the pin bore, a rotationally symmetrical design with respect to the piston axis permits a torsion-proof installation in the engine.

SUMMARY

A steel piston which is improved with respect to friction and fuel consumption is provided.

As a result, it comprises shaft surfaces, one of which is 25-50% narrower than the other. A reduction of the shaft width by 30-35%, in particular about 33%, is particularly preferred. This results in a reduction of hydrodynamic friction, which, according to findings made by the inventors, is relevant with regard to fuel consumption. The selection of the shaft surface to be reduced in respect of its width results from the position of the oil spray nozzle, wherein the unchanged, wider shaft surface is preferably provided on the side with the oil spray nozzle and the opposite shaft surface represents the side to be reduced. According to the invention, the symmetry of rotation normally provided in steel pistons is abandoned, wherein the requirements are still met by the steel piston according to the invention, and not only the friction but also the weight can be reduced advantageously.

This can reduce fuel consumption, for example. The steel piston according to the invention is preferably used in heavy-duty diesel engines. Extensive simulation calculations have shown that the friction of a heavy-duty steel piston at a normal operating point for highway travel is predominantly determined by the hydrodynamic component. Among other factors, hydrodynamic friction depends strongly on the size of the contact surfaces. Therefore, a reduction in fuel consumption is achieved by reducing the width of the shaft contact surfaces of the piston.

Since the steel piston according to the invention has at least one cooling channel, a cooling channel outlet is to be provided which is preferably arranged on the side of the smaller shaft surface. Irrespective of this, the cooling channel outlet is provided centrally in accordance with the invention, so that the oil flowing out reaches the pivoting connecting rod in an advantageous manner and is thus partially transported in the direction of the small connecting rod eye, so that lubrication takes place here in an advantageous manner. This arrangement also advantageously eliminates the need for an additional outlet or drainage hole.

Particularly with regard to demolding, for example from a forging die, embodiments are preferred in which the smaller shaft surface is wider at its end facing the piston crown than at the opposite end.

Typically, the shaft surfaces are connected to the pin hub by so-called connecting walls. The invention described here allows at least one shaft surface to be connected obliquely, which is advantageous for the rigidity of the connection.

With regard to the rigidity of the wider shaft surface, which is preferably provided on the pressure side, it is advantageous if this has at least one convexity, thickening or bulge.

Finally, it is preferred that the steel piston according to the invention consists of at least two components connected by friction welding. The lower part of the piston can be produced by forging or casting. In the forging manufacturing process, a demolding chamfer shall be provided. This results in an embodiment of the shaft surfaces where the shaft surfaces are wider at their respective end facing the piston crown than at the opposite end.

BRIEF DESCRIPTION OF THE DRAWINGS

In the following, the invention is explained in more detail using an embodiment example from the drawings.

The figures show as follows.

DETAILED DESCRIPTION

Figure 1:
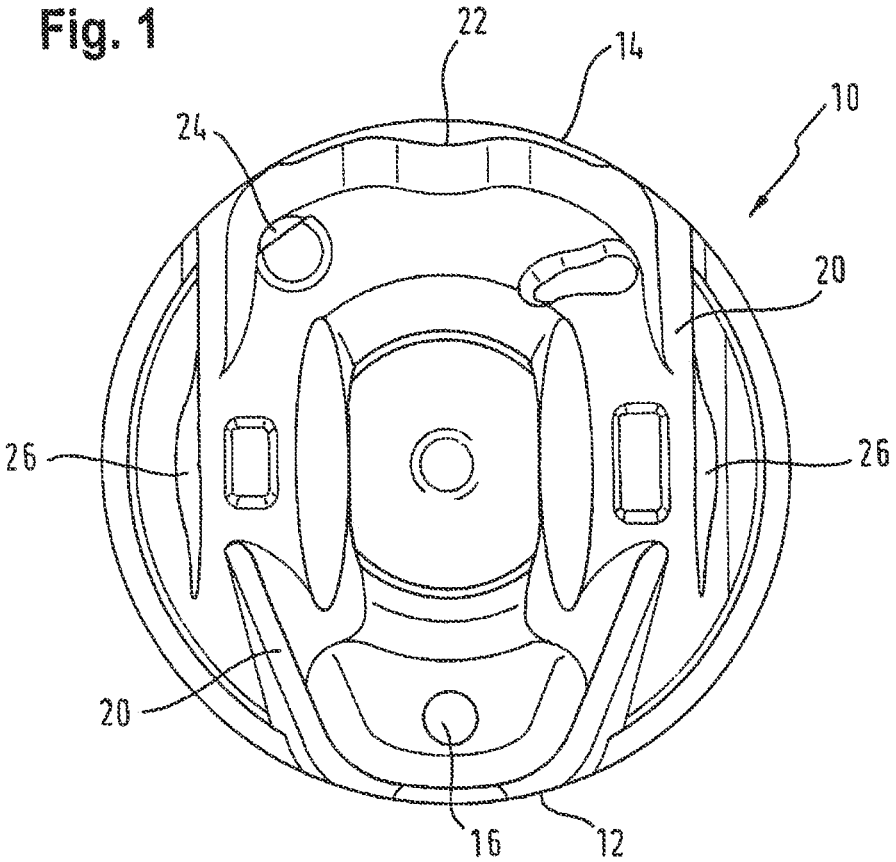
FIG. 1 an underside view of the piston according to the embodiment of the invention.

As can be seen in the piston 10 of FIG. 1, a shaft surface 12, which in the example shown is provided on the counterpressure side, and a shaft surface 14 on the pressure side are connected by connecting walls 20 to a piston hub 26, which comprises the piston pin bore. The shaft surface 12 on the counterpressure side is clearly smaller, in particular narrower, as can be seen additionally in the side view of FIG. 2. However, the shaft surface 14 on the pressure side can also be made smaller if the position of the oil spray nozzle is on the counterpressure side.

FIG. 1 additionally shows that a cooling channel outlet 16 is arranged essentially centrally, while the cooling channel inlet 24 is provided laterally. With regard to the pressure side, FIG. 1 shows a preferred embodiment in such a way that the inner side of the shaft wall has a convexity 22 on this side at the lower end. However, it preferably extends over the entire "height" of the shaft wall in the direction of the piston axis. In other words, the wall of the shaft is essentially thickened in the middle or bulged towards the inside. The convexity, for example, extends over about one third of the width of the shaft surface 14 and, like the two transitions to the wall thickness of the shaft surface 14, is rounded. In this respect, a concavity is created on each side of convexity 22.

Figure 2:
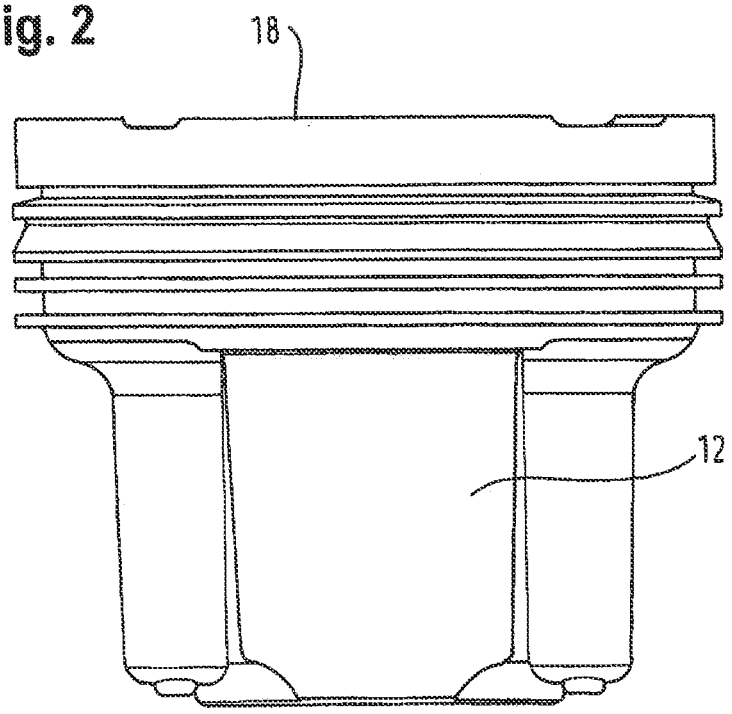
FIG. 2 a side view of the piston according to the embodiment of the invention.

FIG. 2 additionally shows that the smaller shaft surface 12 is slightly wider at its end facing the piston crown 18 than at the opposite end. With the exception of the clearly chamfered lower end, however, the width measured in the circumferential direction at the upper end is a maximum of 120% of the width at the lower end. In addition, the lateral edges of at least one, preferably both shaft surfaces 12, 14 extend largely straight. Finally, in the example shown, the larger shaft surface 14 has a substantially identical width at the upper and lower ends.

The invention claimed is:

1. A steel piston for an internal combustion engine, having at least one cooling channel and shaft surfaces with which the piston, in an installed state, abuts a cylinder bore or a cylinder liner on a pressure side and a counterpressure side, wherein said shaft surfaces are connected to a piston hub by connecting walls, one of said shaft surfaces has a width which is 25-50% smaller than the other of said shaft surfaces, and wherein a cooling channel outlet is disposed inward of said shaft surface and is centrally arranged between said connecting walls on the side of the narrower shaft surface.

2. The piston according to claim 1, wherein the narrower shaft surface is wider at one end directed towards a piston crown than at an end opposite to the piston crown.

3. The piston according to claim 1, wherein at least one of said connecting walls between the shaft surface and the piston hub is designed obliquely.

4. The piston according to claim 1, wherein the wider shaft surface has at least one convexity on the inside.

5. The piston according to claim 1, wherein the piston comprises at least two components joined by friction welding.

* * * * *